US006680445B1

(12) United States Patent
Oravetz et al.

(10) Patent No.: US 6,680,445 B1
(45) Date of Patent: Jan. 20, 2004

(54) LIMITED SPACE CIRCUIT BREAKER MECHANICAL INTERLOCK APPARATUS

(75) Inventors: Thomas A. Oravetz, Placitas, NM (US); Rodger A. Tenholder, Saginaw, TX (US)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 10/329,902

(22) Filed: Dec. 26, 2002

(51) Int. Cl.[7] ..... H01H 9/20

(52) U.S. Cl. ..... 200/50.33; 200/43.14; 200/43.16; 200/43.22

(58) Field of Search ..... 200/43.01, 43.11, 200/43.14, 43.16, 43.19, 43.22, 50.32–50.4

(56) References Cited

U.S. PATENT DOCUMENTS

| | | | | |
|---|---|---|---|---|
| 3,705,280 A | | 12/1972 | Harms | 200/50 C |
| 3,801,758 A | | 4/1974 | Shand et al. | 200/50 C |
| 4,516,100 A | | 5/1985 | Wallace et al. | 335/160 |
| 4,902,859 A | | 2/1990 | Witzmann et al. | 200/50 C |
| 5,393,942 A | | 2/1995 | Reiner et al. | 200/50 C |
| 5,725,085 A | | 3/1998 | Seymour et al. | 200/50.33 |
| 5,874,698 A | * | 2/1999 | Collis | 200/50.33 |
| 5,977,492 A | | 11/1999 | Taylor et al. | 200/50.32 |
| 6,069,328 A | | 5/2000 | Oravetz et al. | 200/50.33 |
| 6,180,897 B1 | * | 1/2001 | Montague et al. | 200/50.35 |
| 6,469,264 B2 | * | 10/2002 | Benda | 200/43.14 |

* cited by examiner

*Primary Examiner*—Michael Friedhofer
(74) *Attorney, Agent, or Firm*—Christopher C. Dremanr

(57) ABSTRACT

A circuit breaker mechanical interlock apparatus is provided for preventing an electrical system from being energized by more than one of a plurality of power sources at any given time. The apparatus includes a housing that defines a receptacle for receiving two or more circuit breakers having actuating switches for energizing the electrical system. The apparatus further includes one or more interlock slides movably mounted on the housing and a faceplate for restricting unauthorized access to the slides. The number of interlock slides is one fewer than the number of circuit breakers so that the slides can be positioned to provide access to only one of the switches of the circuit breakers, while the remaining switches of the circuit breakers cannot be accessed. Each of the switches of the circuit breakers can be individually accessed without the slides extending beyond the periphery of the housing.

26 Claims, 10 Drawing Sheets

LIMITED SPACE CIRCUIT BREAKER MECHANICAL INTERLOCK APPARATUS

FIELD OF THE INVENTION

The present invention relates generally to a mechanical interlock apparatus for two or more circuit breakers. More particularly, the invention relates to an improved mechanical interlock for two or more switch-type circuit breakers that reduces the amount of space required to operate the mechanical interlock, while still providing easy access for replacement of individual circuit breakers and preventing dismantling using ordinary hand tools.

BACKGROUND OF THE INVENTION

It is common to restrict the movement, and thereby prevent the unintended operation, of switch-type circuit breakers. It is particularly desirable to prevent the unintended operation of a switch-type circuit breaker when more than one power source is available to provide electrical service. For example, secondary power sources, such as emergency or back-up generators, are commonly employed to maintain LifeLine Support (e.g., 911 emergency telephone service) in the event that the primary power source, typically commercial utility power, is interrupted. If the primary and secondary power sources are not prevented from being energized at the same time, referred to herein as "interlocked," electrical power can flow unexpectedly and cause damage to equipment or serious injury to personnel. A circuit breaker interlock apparatus is utilized to ensure that no more than one power source energizes the electrical system at the same time. Although electrically activated circuit breaker interlocks may be utilized to automatically isolate multiple power sources, there are situations when a mechanically activated interlock is preferred. A mechanically activated circuit breaker interlock, referred to herein as a "circuit breaker mechanical interlock," is typically less costly to install and maintain, and is equally reliable as long as there are service personnel present to operate the mechanical interlock.

Known circuit breaker mechanical interlock apparatus isolate one or more circuit breakers and thereby prevent more than one power source from energizing an electrical system at the same time. In particular, known mechanical interlock apparatus prevent more than one switch-type circuit breaker from being operated at any given time. An example of such a circuit breaker mechanical interlock apparatus is shown and described in U.S. Pat. No. 6,069,328, which is assigned to the assignee of the present invention. The circuit breaker mechanical interlock apparatus includes a housing that defines a receptacle for receiving two or more switch-type circuit breakers mounted in parallel, linear alignment and an interlock plate positioned adjacent the switches of the circuit breakers. The interlock plate has an opening that is sized to provide access to only one of the switches at a time. The interlock plate is moveable on the housing relative to the circuit breakers between a first position wherein one of the switches of the switch-type circuit breakers is accessible through the opening, but the remaining switches are not, and a second position wherein a different one of the switches of the switch-type circuit breakers is accessible through the opening, but the remaining switches are not.

The interlock plate shown and described in U.S. Pat. No. 6,069,328 cannot be moved from the first position to the second position unless all of the switches are in an "OFF" or "NEUTRAL" position such that the electrical system is not energized. Once the interlock plate is moved from the first position to the second position, the switch that is accessible through the opening in the second position may then be moved to the "ON" position. However, as illustrated by the phantom lines in FIG. 2 of the U.S. Pat. No. 6,069,328 , the interlock plate extends substantially beyond the perimeter of the housing when the interlock plate is positioned to access the left-most circuit breaker. Obviously, the interlock plate will extend substantially beyond the perimeter of the housing when the interlock plate is similarly positioned to access the right-most circuit breaker. As a result, a lateral space greater than the width defined by the perimeter of the housing is required to operate the circuit breaker mechanical interlock. Of course, the width of the housing could simply be increased to accommodate the lateral movement of the interlock plate. Alternatively, the circuit breakers could be mounted vertically to conserve lateral space. However, the increased width of the housing (or the increased height of the housing if the circuit breakers are arranged vertically) would likewise interfere with the operation and/or placement of other components of the electrical power system whenever dense packaging is required. Thus, while the apparatus of the U.S. Pat. No. 6,069,038 is suitable for use in many instances, there are situations in which there is insufficient space available adjacent the housing to operate such a circuit breaker mechanical interlock. Accordingly, a circuit breaker mechanical interlock apparatus is needed that reduces the amount of space required to operate the mechanical interlock, without unnecessarily increasing the overall width of the apparatus.

BRIEF DESCRIPTION OF THE DRAWINGS

The present invention will be described in conjunction with the accompanying drawings in which like reference numerals represent the same or similar parts in the various views. The drawings, which are incorporated in and constitute a part of this specification, provide a further understanding of the invention, illustrate various embodiments of the invention, and, together with the description, help to fully explain the principles and objects thereof. More specifically.

DETAILED DESCRIPTION OF THE INVENTION

The invention is described more fully hereinafter with reference to the accompanying drawings, in which one or more preferred embodiments of the invention are shown. The invention may, however, be embodied in many different forms, and therefore, should not be construed as being limited to the any embodiment shown and described herein. One or more illustrative embodiments are set forth herein so that this description will be thorough and complete, and will fully convey the best mode of the claimed invention, while enabling those skilled in the art to make and practice the invention without undue experimentation.

Figure 1:
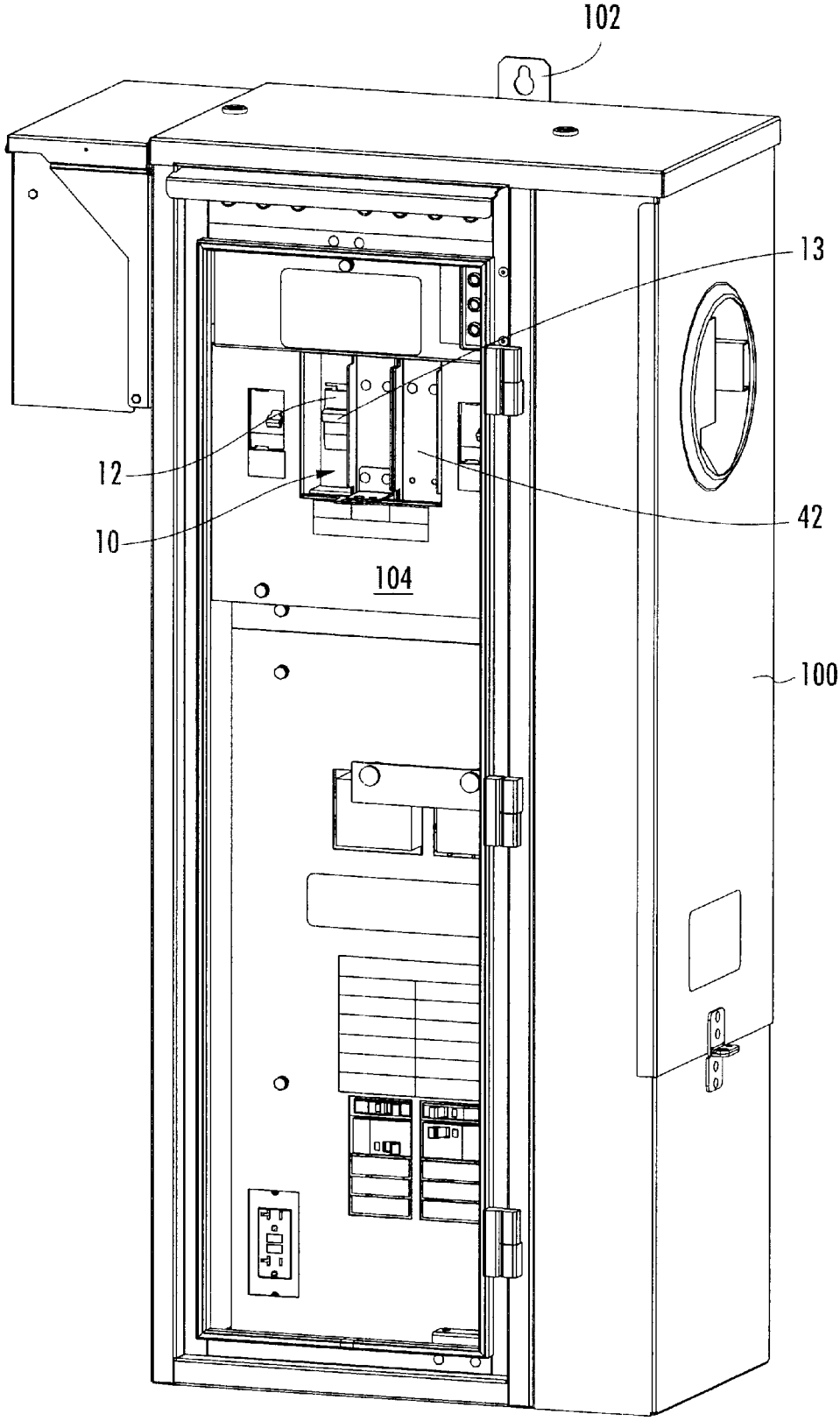
FIG. 1 is a perspective view of a circuit breaker mechanical interlock apparatus according to the invention mounted within an exemplary electrical enclosure.
Figure 2:
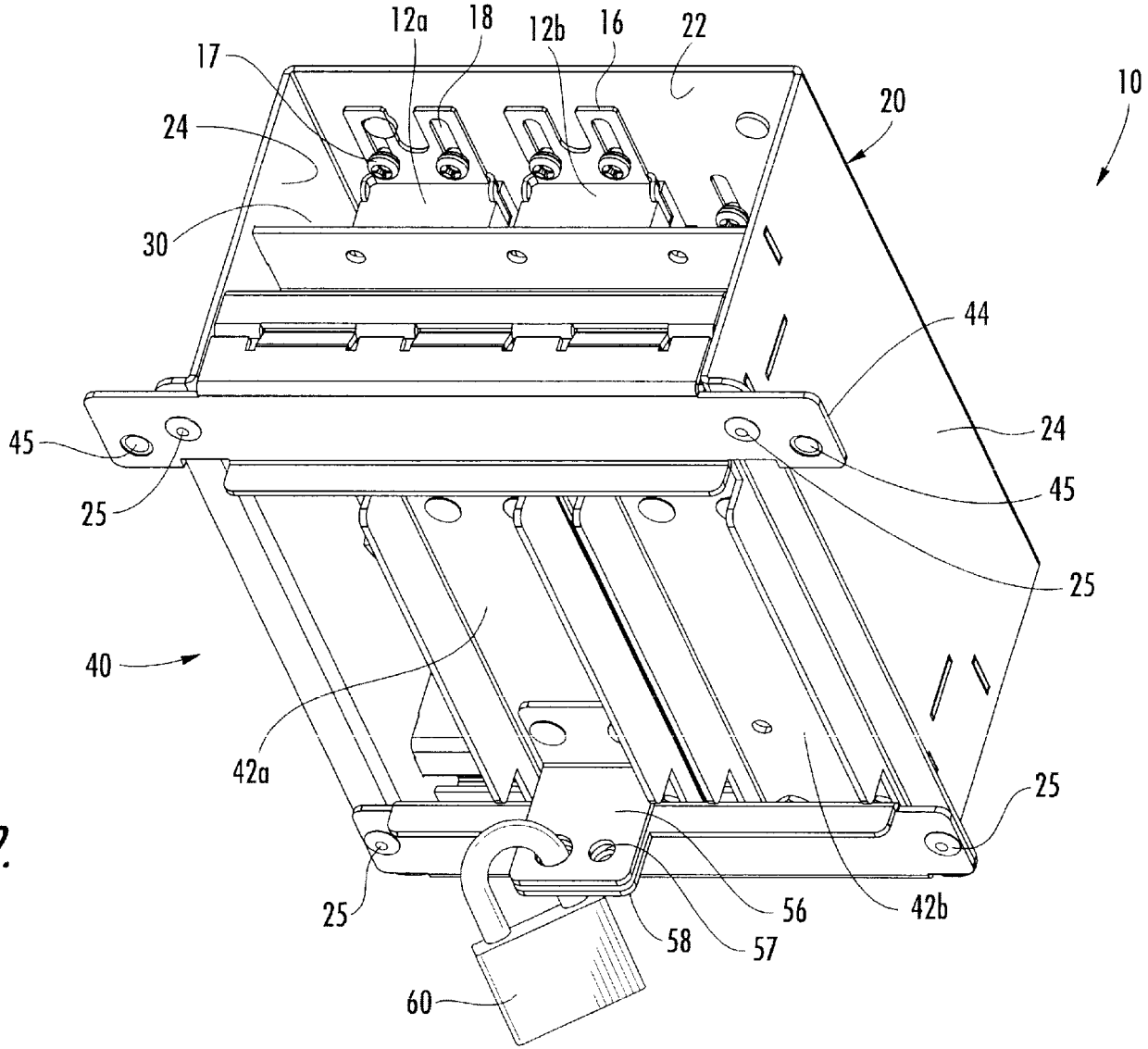
FIG. 2 is a perspective view of a preferred embodiment of a circuit breaker mechanical interlock apparatus constructed in accordance with the invention.

Referring now to the accompanying drawings, a circuit breaker mechanical interlock apparatus, indicated generally at 10, is shown in FIG. 1 mounted within a conventional electrical enclosure 100. The electrical enclosure 100 may be any structure for housing power equipment, such as a power and transfer switch cabinet, examples of which include the PowerPedestal™ Universal AC Power and Transfer Switch Cabinet and the SlimPed™ Universal Power Transfer Pedestal available from Corning Cable Systems of Hickory, N.C. Typically, the electrical enclosure 100 is mounted to a wall inside a building, for example, a power transfer facility or a telephone company network office, by a plurality of mounting flanges 102. However, the electrical enclosure 100 may also be pad mounted or pole mounted, as is well known to those skilled in the art. Regardless, the electrical enclosure 100 is electrically connected to more than one source of electrical power for energizing an electrical system, such as a telephone network. Furthermore, other electrical components (not shown) are mounted within the electrical enclosure 100 adjacent to the mechanical interlock apparatus 10 for receiving, switching and distributing electrical power to at least one electrical system.

A preferred embodiment of the mechanical interlock apparatus 10 constructed in accordance with the invention is shown in FIGS. 2–7. The mechanical interlock apparatus 10 comprises a housing 20 and an interlock assembly 40. The interlock assembly 40 comprises at least one interlock slide 42 that is movably mounted on the housing 20, for a purpose to be described hereinafter. The housing 20 is made of a rigid material such as metal, plastic or composite, and preferably is made of a relatively thin sheet metal, such as aluminum. The housing 20 comprises a back wall 22 and a pair of side walls 24 that are spaced apart and depend outwardly from the back wall 22. As shown, the side walls 24 are generally perpendicular to the back wall 22. However, the side walls 24 may instead depend from the back wall 22 at any convenient acute or obtuse angle. The back wall 22 and the side walls 24 may be formed and joined in any conventional manner, but preferably, are formed from a single sheet of aluminum that is bent into a U-shape, commonly referred to as a "hat-section." The housing 20 may further comprise a top wall and/or a bottom wall. Preferably, however, the top and the bottom of the housing 20 are at least partially open, as shown herein. The front of the housing 20 opposite the back wall 22 is also substantially open for a purpose to be described hereinafter. Regardless of its configuration or geometry, the housing 20 defines an interior cavity, referred to herein as a receptacle 30, for receiving at least two switch-type circuit breakers 12 (indicated generally in FIG. 1). In the preferred embodiments shown and described herein, the receptacle 30 is sized to receive exactly three switch-type circuit breakers 12. However, the receptacle 30 may be sized to receive any convenient number of suitably sized switch-type circuit breakers 12 that may be required for a particular installation. Furthermore, the side walls 24 define an outer perimeter of the housing 20 in the lateral directions. As is shown herein and will be described in greater detail hereinafter, the interlock slide(s) 42 are movable on the housing 20 such that the switch-type circuit breakers 12 are individually accessible, yet the interlock slide(s) 42 do not extend beyond the outer perimeter defined by the housing 20 in any position. Accordingly, the mechanical interlock apparatus 10 is suitable for use in a high density electrical enclosure 100.

Preferably, the switch-type circuit breakers (referred to hereinafter simply as circuit breakers 12) are "main disconnect breakers" or "main breakers" of the type commonly utilized in the aforementioned power and transfer switch cabinets. The circuit breakers 12 may be any size (i.e., amperage), for example up to about 300 amp rated. In the exemplary embodiments shown and described herein, the circuit breakers 12 are preferably 10–125 amp main circuit breakers available from Square D Company, the North American Division of Schneider Electric of Paris, France. Each circuit breaker 12 is provided with a manually operable actuating switch 13 (indicated generally in FIG. 1) for electrically connecting the circuit breaker 12 to the electrical system. The switch 13 may be electrically connected to the electrical system in any suitable manner. Preferably, however, circuit breaker 12 is provided with a plurality of wire openings 14 (FIGS. 6 and 7) for receiving and terminating electrical conductors (not shown) in a conventional manner. The switch 13 has at least an "OFF" position and an "ON" position as is well known, and may further have a "NEUTRAL" position between the OFF and ON positions. In the exemplary embodiments shown and described herein, the circuit breaker 12 is in the OFF position when the switch 13 is in its lowermost location (see FIGS. 3–5) and is in the ON position when the switch 13 is in its uppermost location (see FIGS. 8–10). If provided, the circuit breaker 12 is in the NEUTRAL position when the switch 13 is located medially between its lowermost location and its uppermost location. As is conventional, the electrical system is not energized when the switch 13 is in the OFF position or the NEUTRAL position, and is energized when the switch 13 is in the ON position. Such circuit breakers having two-way or three-way switches are well known, and thus, their design and/or configuration forms no part of the present invention, except as described hereinafter.

The circuit breakers 12 may be mounted within the receptacle 30 defined by the housing 20 in any suitable manner. As shown herein, the circuit breakers 12 are mounted to the back wall 22 of the housing 20 by adjustable mounting plates 16. Mounting plates 16 preferably have elongated slots 18 formed therein that permit fasteners 17 to be positioned immediately adjacent the top and bottom of the circuit breaker 12. Accordingly, the location of the circuit breaker 12 is fixed and the circuit breaker 12 cannot move vertically relative to the back wall 22 unless the fasteners 17 are first loosened and removed, and the mounting plates 16 are removed. In the preferred embodiments shown and described herein, the left-hand circuit breaker 12*a* and the center circuit breaker 12*b* are high ampere Type QOU Class 720 thermal magnetic miniature circuit breakers, such as Model No. QOU2100 manufactured by the aforementioned Square D Company, while the right-hand circuit breaker 12*c* is a low ampere Type QOU Class 720 thermal magnetic miniature circuit breaker, such as Model No. QOU230 likewise manufactured by the Square D Company. As previously mentioned, however, the circuit breakers 12 may be any size, shape or type of electrical power circuit breaker that is suitable for a particular application. Furthermore, the circuit breakers 12 may all be the same, may all be different, or as shown, may comprise two different sizes, shapes and types. If necessary, the size and configuration of the housing 20 may be modified without departing from the invention to accommodate the desired circuit breakers 12. Regardless, the circuit breakers 12 are mounted within the receptacle 30 such that the switches 13 are accessible adjacent the front of the housing 20 between the side walls 24. As will be described more fully hereinafter, the switches 13 are individually accessible at the front of the housing 20 through the interlock assembly 40. However, no more than one of the switches 13 is accessible through the interlock assembly 40 at any given time.

Figure 4:
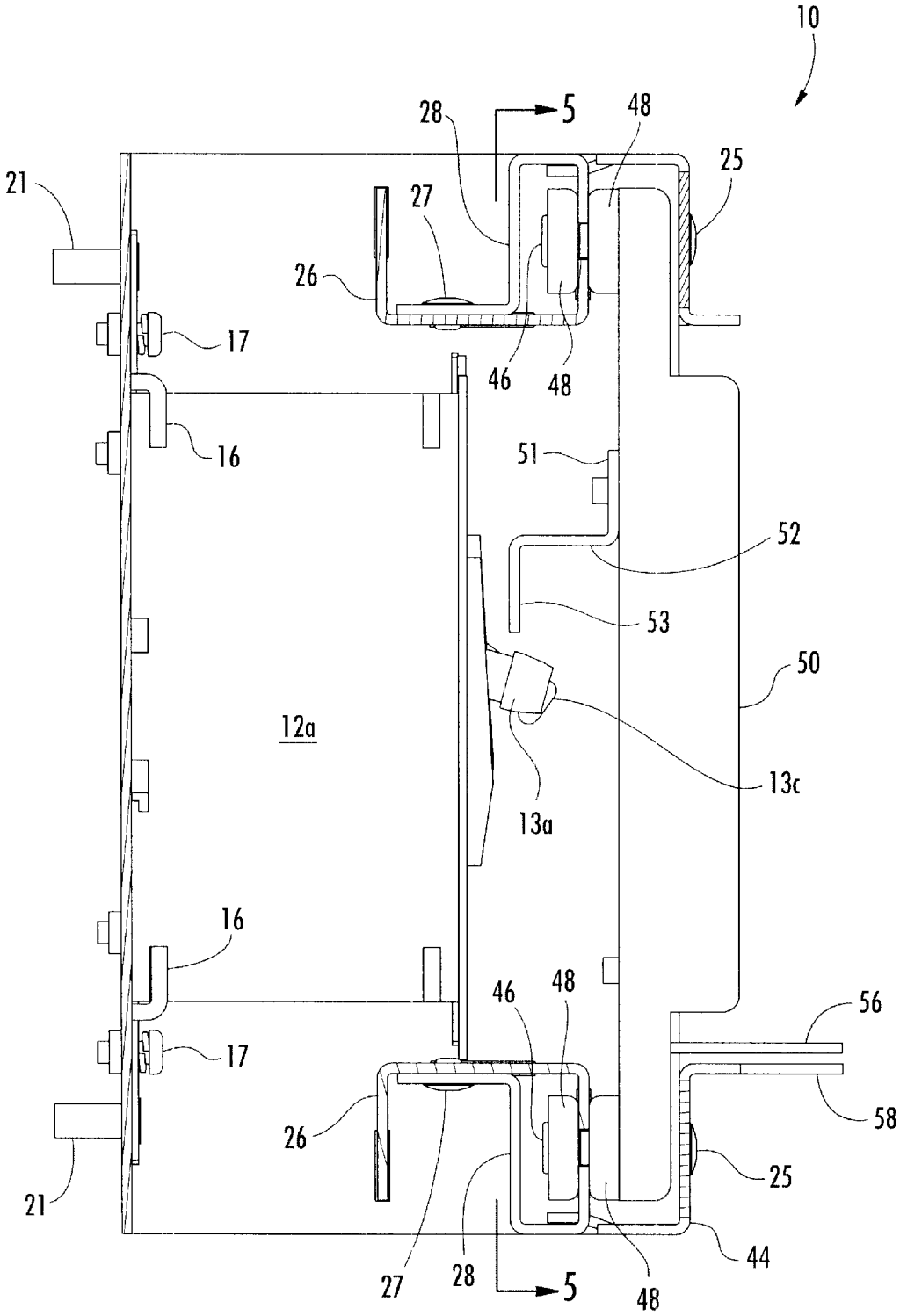
FIG. 4 is a partial sectional view of the circuit breaker mechanical interlock apparatus of FIG. 2 taken along the line 4—4 of FIG. 3.
Figure 6:
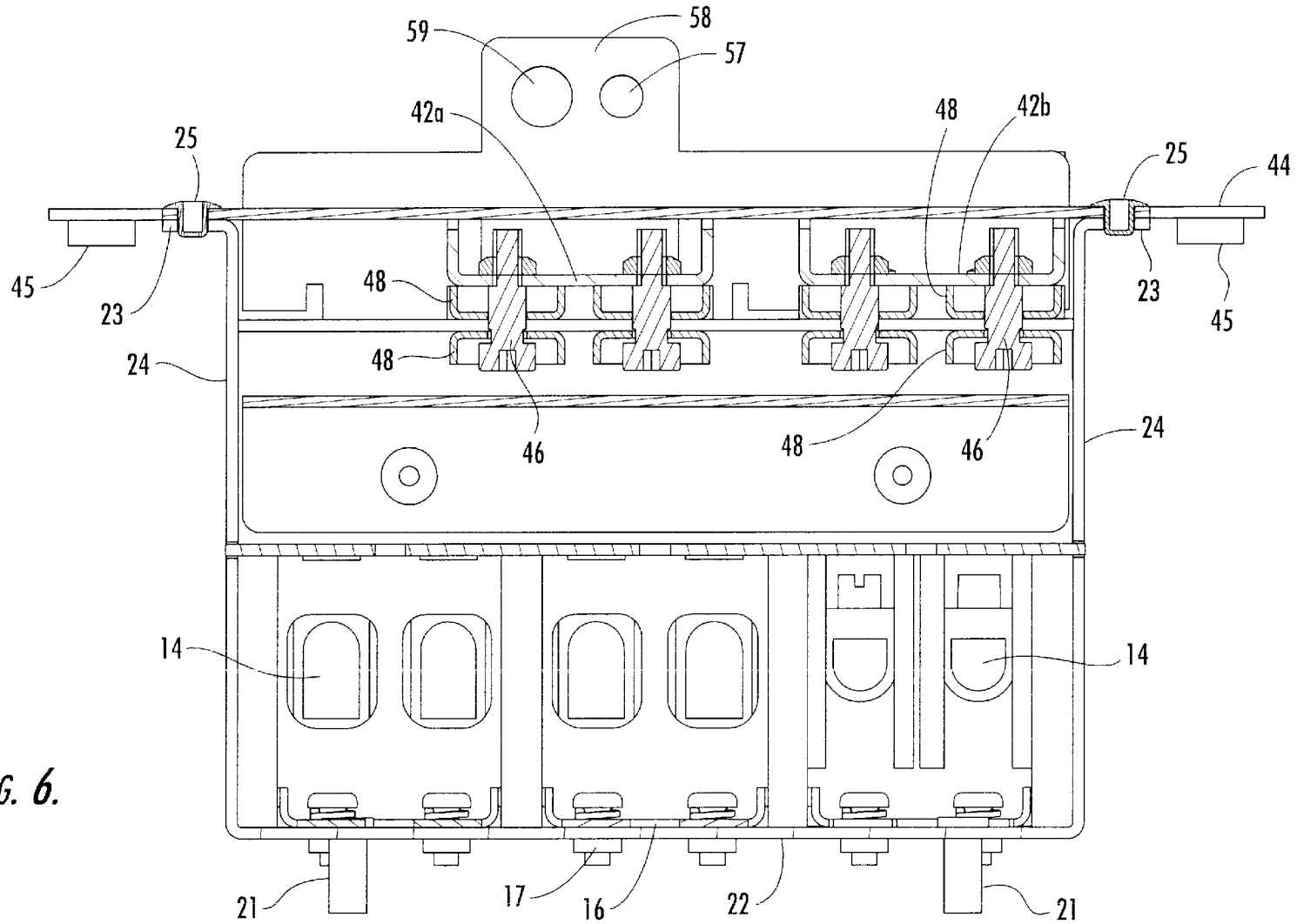
FIG. 6 is a partial sectional view of the circuit breaker mechanical interlock apparatus of FIG. 2 taken along the line 6—6 of FIG. 3.

Interlock assembly 40 comprises one or more interlock slides 42 (indicated generally in FIG. 1) and a faceplate 44 that defines a window 43 on the front of the housing 20 for operating the interlock slides 42 and for accessing the switches 13 of the circuit breakers 12. Each interlock slide 42 is made of a rigid material such as metal, plastic or composite, and preferably is made of a relatively thin sheet metal, such as aluminum. It should be noted that the number of interlock slides 42 is always one fewer than the number of circuit breakers 12. Therefore, if the number of circuit breakers 12 is mathematically defined as n, where n is an integer equal to two or more, then the number of interlock slides 42 is mathematically defined as n−1. As shown and described herein, there are three circuit breakers 12, and thus, two interlock slides 42. The interlock slides, also referred to herein as "slides," 42 are movably mounted on the housing 20 to permit selective access to only one of the switches 13 at any given time. Each slide 42 may be movably mounted on the housing 20 in any suitable manner. For example, the housing may be provided with a laterally extending slot and the slides 42 provided with pins that protrude into and engage the slot. Alternatively, the slides 42 could be provided with a lip that hangs from and engages a laterally extending rail. As best shown in FIGS. 4 and 6, each slide 42 comprises at least one externally threaded shoulder bolt 46 and a pair of internally threaded cup washers 48. Preferably, each slide 42 comprises an upper pair of shoulder bolts 46 and a lower pair of shoulder bolts 46. Each shoulder bolt 46 is secured to the slide 42 and engages the cup washers 48 such that a narrow space is defined between the cup washers 48. The housing 20 comprises an inner flange 26 and an outer flange 28 adjacent both the top and the bottom of the housing 20, at least one of which is secured, for example by welding, to the side walls 24. As shown herein in FIG. 4, the inner flanges 26 are secured to the side walls 24 adjacent the top and bottom of the housing 20, and the outer flanges 28 are secured to the inner flanges 26 by fasteners 27, for example rivets. The free ends of the inner flanges 26 and the outer flanges 28 define a slot therebetween that extends laterally between the side walls 24. The pair of cup washers 48 are positioned on either side of the inner flanges 26 and the outer flanges 28 such that the shoulder bolts 46 are received within the slot defined by the inner flanges 26 and the outer flanges 28. As a result, the slides 42 are substantially free to move laterally along the slot between the side-walls 24 of the housing 20.

Figure 7:
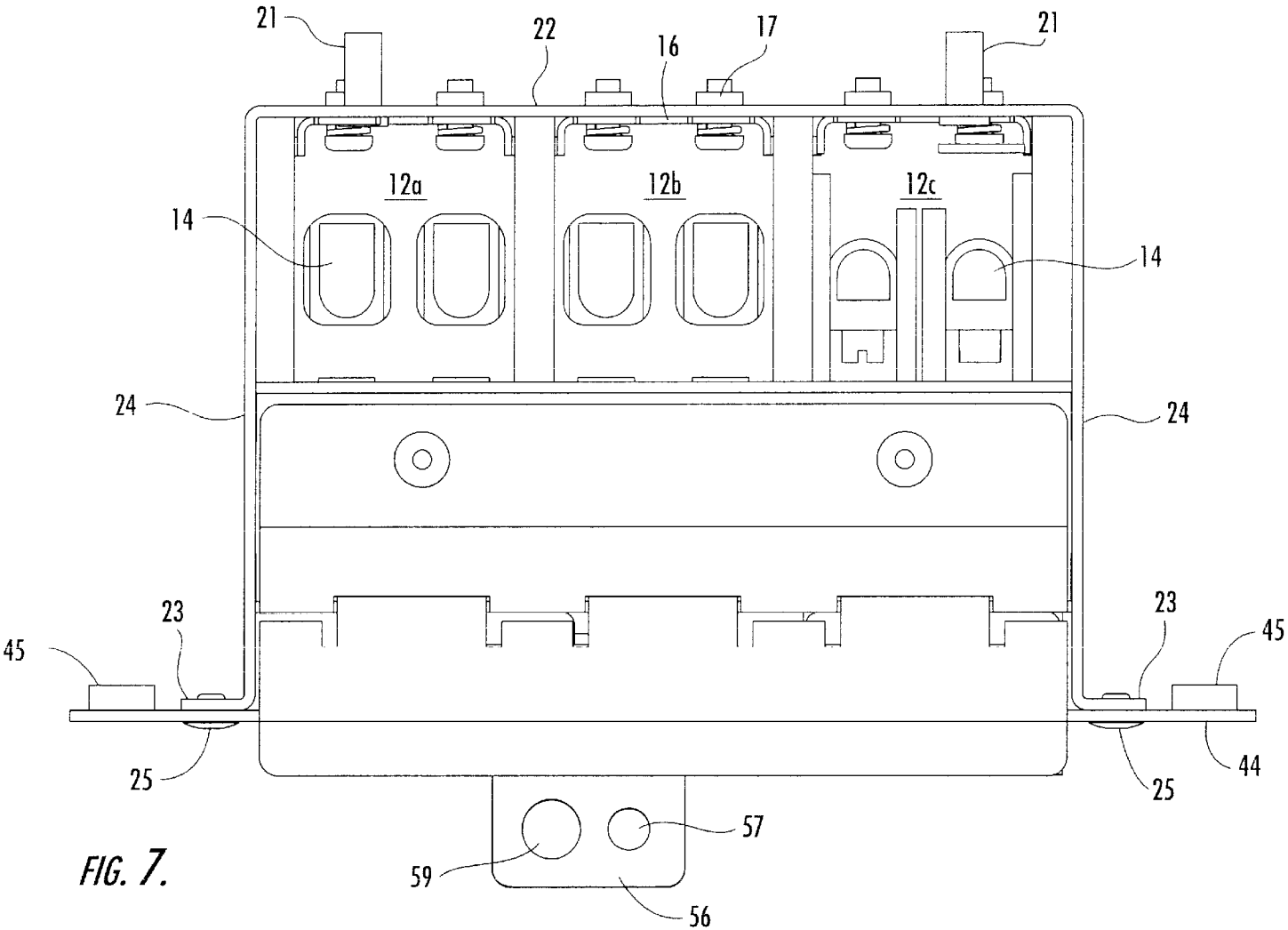
FIG. 7 is a top view of the circuit breaker mechanical interlock apparatus of FIG. 2.

Each slide 42 further comprises at least one, and preferably a pair, of handles 50 for moving the slide 42 in the lateral direction. The handles 50 may be secured to the slide 42 in any suitable manner. Preferably, however, the slide 42 and the handles 50 are integrally formed by bending the side edges of the slide 42 outwardly. Accordingly, the slide 42 has a generally U-shaped cross-section in the region defined by the window 43. The faceplate 44 may be secured to the housing 20 in any suitable manner. As best shown in FIG. 7, the side walls 24 of the housing 20 are each provided with an outwardly extending flange 23 having at least one hole that receives a fastener 25, for example a rivet, to secure the faceplate 44 to the housing 20. The rivets 25 prevent the faceplate 44 from being removed from the housing 20 with ordinary hand tools, such as a screwdriver. Thus, the rivets 25 restrict unauthorized access to the shoulder bolts 46 to remove the slides 42 and thereby gain access to more than one of the switches 13 of the circuit breakers 12 at a given time. As a result, the mechanical interlock apparatus 10 is considered to be "tamper-proof," as that term is commonly understood by one of ordinary skill in the art. In turn, housing 20 is mounted within electrical enclosure 100 using threaded studs 21. Furthermore, faceplate 44 may be provided with one or more internally threaded holes 45 that receives a fastener, for example an externally threaded thumb screw, to secure a cover 104 (FIG. 1), commonly referred to as a "dead front," over the housing 20. The housing 20 is concealed by the dead front 104 once the mechanical interlock apparatus 10 is installed within the electrical enclosure 100, thereby restricting access to the faceplate 44 and the housing 20.

Figure 5:
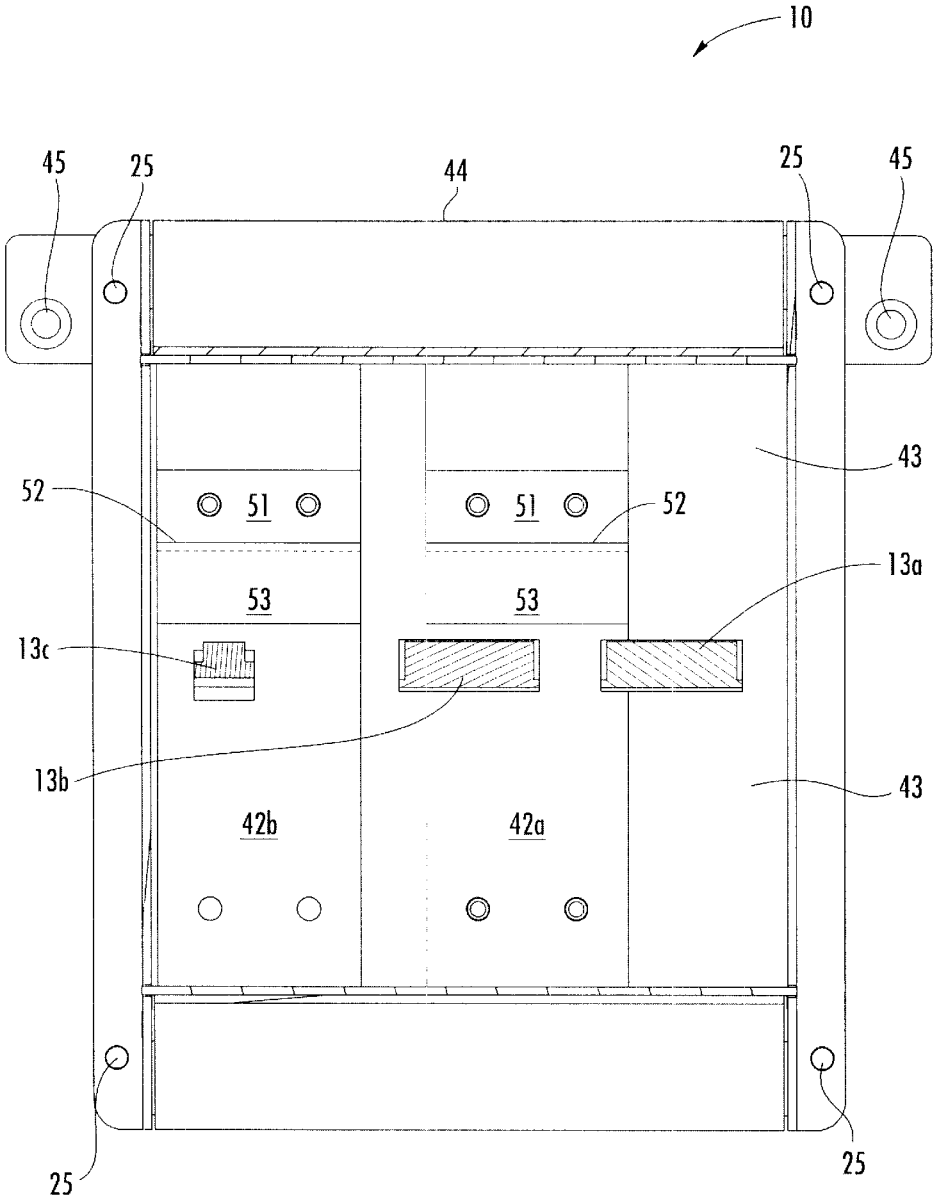
FIG. 5 is a partial sectional view of the circuit breaker mechanical interlock apparatus of FIG. 2 taken along the line 5—5 of FIG. 4.

The interlock assembly 40 further comprises a locking bar 52 affixed to the underside of each interlock slide 42. The locking bar 52 is made of a rigid material, such as metal, and may be secured to the slide 42 in any suitable manner. As best shown herein in FIG. 4, the locking bar 52 comprises a thin Z-shaped flange having a first leg 51 secured to the slide 42 by fasteners 54 that engage holes provided through the slide 42. The locking bar 52 has a second leg 53 opposite the first leg 51 that is positioned adjacent the switches 13 of the circuit breakers 12. The second leg 53 of the locking bar 52 extends laterally across the width of the slide 42, and as best shown in FIG. 5, preferably extends laterally substantially the entire width of the slide 42. The locking bar 52 prevents the slide 42 from being moved laterally past a switch 13 when the switch 13 is in the ON position. Accordingly, the switch 13 must first be moved to a position other than the ON position (i.e., the NEUTRAL or OFF position) before the slide 42 can be moved in a lateral direction. As shown in FIGS. 4 and 5, all three of the switches 13 of the circuit breakers 12 are in the NEUTRAL or OFF positions.

Figure 3:
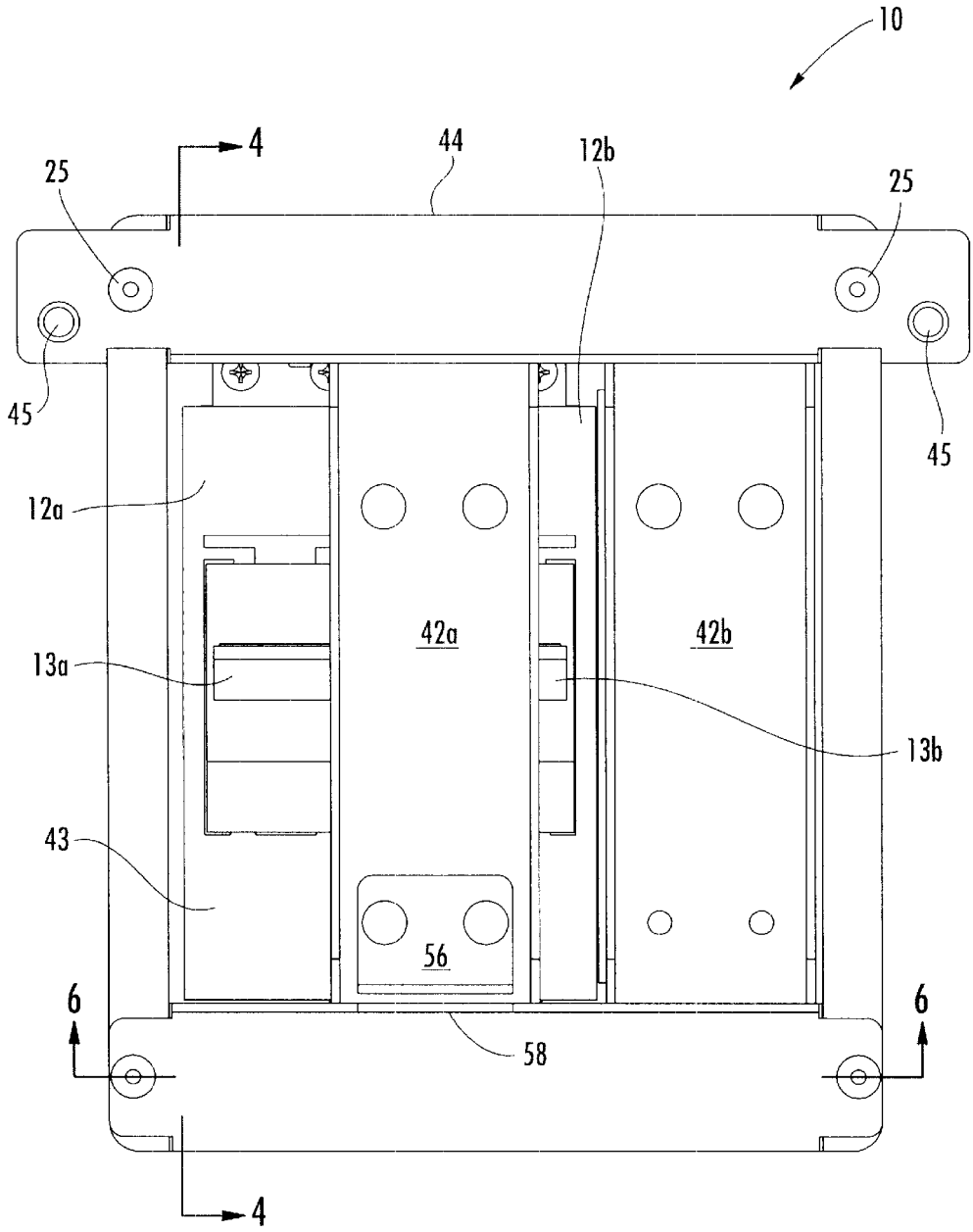
FIG. 3 is a front elevation view of the circuit breaker mechanical interlock apparatus of FIG. 2.

It should be noted that FIGS. 2–7 illustrate the interlock assembly 40 of the mechanical interlock apparatus 10 in a predetermined position wherein all of the switches 13 of the circuit breakers 12 are in the NEUTRAL or OFF position and none of the switches 13 are accessible. As is most apparent in FIG. 4, the switch 13*a* of the left-hand circuit breaker 12*a* and the switch 13*b* of the center circuit breaker 12*b* are shown in the NEUTRAL position, while the switch 13*c* of the right-hand circuit breaker 12*c* is shown in the OFF position. Accordingly, none of the switches 13 can be actuated (i.e., moved to the "ON" position) to energize the electrical system. This position is commonly referred to as the "lock-out" or "safety" position and is desirable to prevent the electrical system from being energized by any power source during, for example, repair of an electrical component electrically connected to the power sources. As best shown in FIG. 3, the safety position is achieved by moving the right-hand slide 42*b* laterally to the right until it overlies the switch 13*c* of the right-hand circuit breaker 12*c*. The left-hand slide 42*a* is then moved laterally to the left or right until it partially overlies the switch 13*b* of the center circuit breaker 12*b* and partially overlies the switch 13*a* of the left-hand circuit breaker 12*a*. The slides 42 may be retained in the safety position in any suitable manner. As shown herein, the left-hand slide 42*a* is provided with an L-shaped flange 56 and the faceplate 44 is provided with a complimentary L-shaped flange 58. The flanges 56, 58 may be secured to the left-hand slide 42*a* and the faceplate 44, respectively, in any suitable and tamper-proof manner, for example by rivets, that prevents the flanges 56, 58 from being easily removed using ordinary hand tools. Each flange 56, 58 is provided with at least one hole 57, 59 (FIGS. 6 and 7) for receiving the shank of a padlock 60 (FIG. 2) to lock the left-hand slide 42*a* to the faceplate 44. Accordingly, the left-hand slide 42*a* cannot be moved laterally in either direction relative to the housing 20, and thus, relative to the switches 13 of the circuit breakers 12. As a result, none of the switches 13 of the circuit breakers 12 can be accessed to energize the electrical system. If desired, the above configuration can be modified such that the left-hand slide 42*a* overlies the left-hand circuit breaker 12*a* and the right-hand slide 42*b* partially overlies the switch 13*b* of the center circuit breaker 12*b* and partially overlies the switch 13*c* of the right-hand circuit breaker 12*c* by simply securing the flange 56 to the right-hand slide 42*b* and re-positioning the flange 58 on the faceplate 44.

Figure 8:
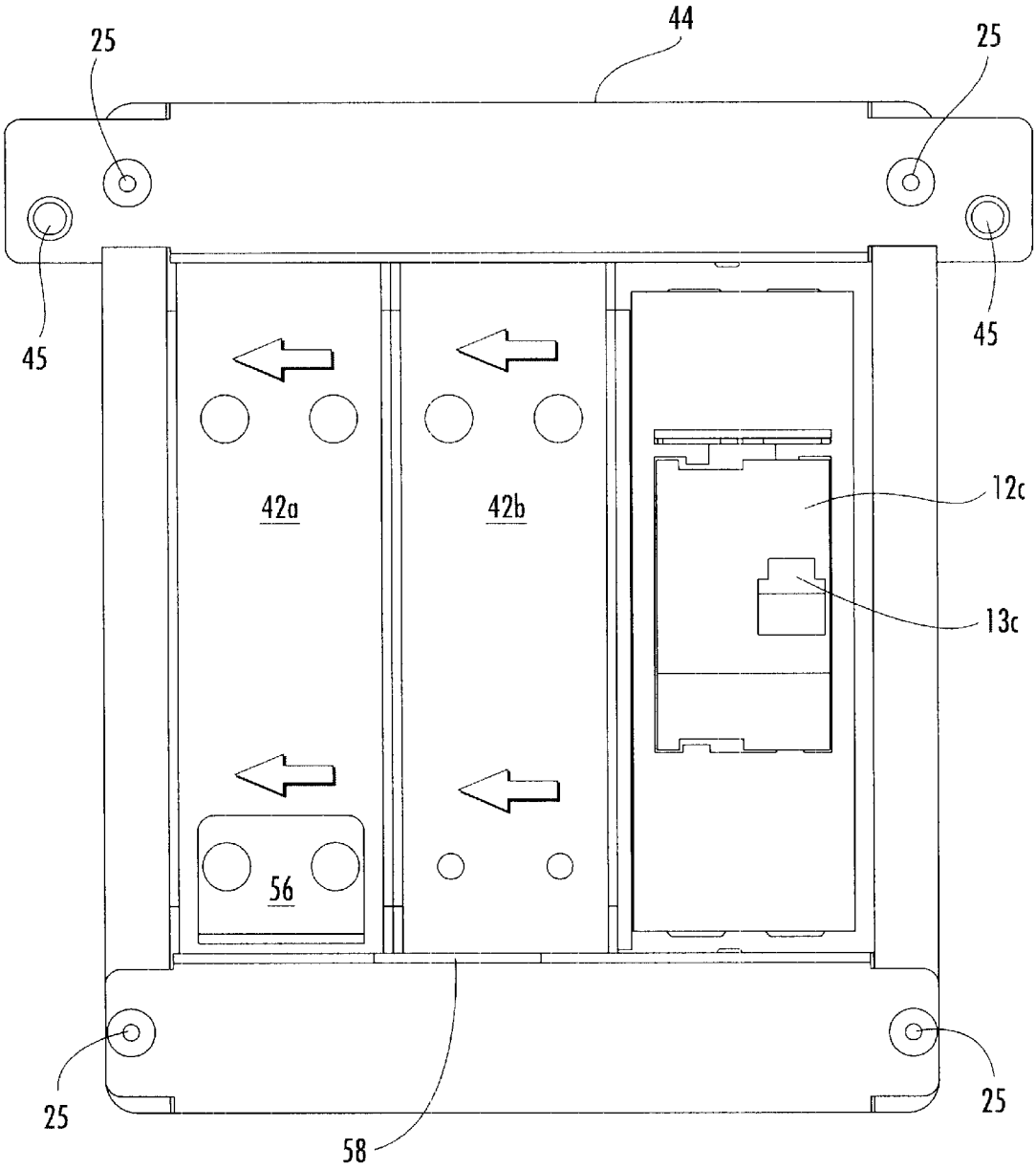
FIG. 8 is a front view of the circuit breaker mechanical interlock apparatus of FIG. 2 illustrating a first operational position of the interlock slides wherein the switch of the right-hand circuit breaker is accessible, but the switches of the remaining circuit breakers are not.

FIG. 8 illustrates a first operational position of the mechanical interlock apparatus 10 wherein the switch 13*c* of the right-hand circuit breaker 12*c* is accessible, but the switch 13*b* of the center circuit breaker 12*b* and the switch 13*a* of the left-hand circuit breaker 12*a* are not accessible. Accordingly, the switch 13*c* of the right-hand circuit breaker 12*c* can be moved between the OFF, NEUTRAL and ON positions as desired to de-energize, neutralize and/or energize the electrical system. The mechanical interlock apparatus 10 is positioned in the first operational position by first accessing each of the circuit breakers 12 in turn and placing the switch 13 of the circuit breaker 12 in the OFF or NEUTRAL position. The left-hand slide 42*a* is then moved laterally between the inner flanges 26 and the outer flanges 28 to the left as indicated by the arrows thereon until the left-hand slide 42*a* overlies the switch 13*a* of the left-hand circuit breaker 12*a*. The right-hand slide 42*b* is then moved laterally between the inner flanges 26 and the outer flanges 28 to the left as indicated by the arrows thereon until the right-hand slide 42*b* overlies the switch 13*b* of the center circuit breaker 12*b*. As shown in FIG. 8, the switch 13*c* of the right-hand circuit breaker 12*c* is in the ON position and, as required, the switch 13*b* of the center circuit breaker 12*b* and the switch 13*a* of the left-hand circuit breaker 12*a* are in the NEUTRAL or OFF position. It should be noted that with the left-hand slide 42*a* positioned over the left-hand circuit breaker 12*a* and the right-hand slide 42*b* positioned over the center circuit breaker 12*b* as shown, the switch 13*c* of the right-hand circuit breaker 12*c* can be moved to the OFF position or to the NEUTRAL position. The corresponding fasteners 17 can then be loosened and the mounting plates 16 separated so that the right-hand circuit breaker 12*c* can be removed through the window 43 defined by the faceplate 44. Accordingly, the right-hand circuit breaker 12*c* can be replaced without dismantling either of the interlock slides 42*a*, 42*b*, thereby preserving the tamper-proof safety features of the invention previously described.

Figure 9:
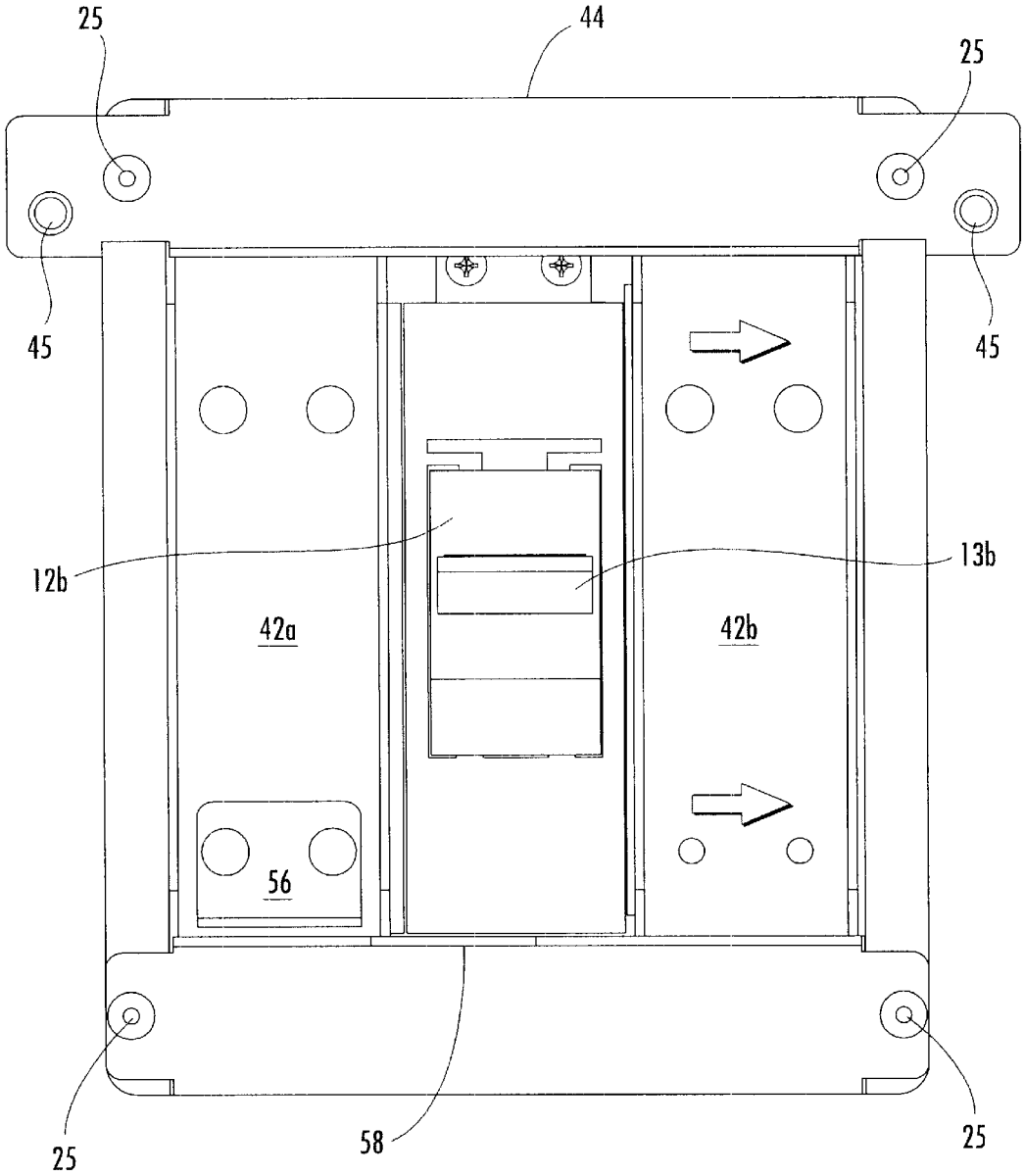
FIG. 9 is a front view of the circuit breaker mechanical interlock apparatus of FIG. 2 illustrating a second operational position of the interlock slides wherein the switch of the center circuit breaker is accessible, but the switches of the remaining circuit breakers are not.

FIG. 9 illustrates a second operational position of the mechanical interlock apparatus 10 wherein the switch 13*b* of the center circuit breaker 12*b* is accessible, but the switch 13*c* of the right-hand circuit breaker 12*c* and the switch 13*a* of the left-hand circuit breaker 12*a* are not accessible. Accordingly, the switch 13*b* of the center circuit breaker 12*b* can be moved between the OFF, NEUTRAL and ON positions as desired to de-energize, neutralize and/or energize the electrical system. The mechanical interlock apparatus 10 is positioned in the second operational position from the first operational position by first moving the switch 13*c* of the circuit breaker 12*c* from the ON position to the OFF position or to the NEUTRAL position. The right-hand slide 42*b* is then moved laterally between the inner flanges 26 and the outer flanges 28 to the right as indicated by the arrows thereon until the right-hand slide 42*b* overlies the switch 13*c* of the right-hand circuit breaker 12*c*. As shown in FIG. 9, the switch 13*b* of the center circuit breaker 12*b* is in the ON position and, as required, the switch 13*a* of the left-hand circuit breaker 12*a* and the switch 13*c* of the right-hand circuit breaker 12*c* are in the NEUTRAL or OFF position. It should be noted that with the left-hand slide 42*a* positioned over the left-hand circuit breaker 12*a* and the right-hand slide 42*b* positioned over the right-hand circuit breaker 12*c* as shown, the switch 13*b* of the center circuit breaker 12*b* can be moved to the OFF position or to the NEUTRAL position. The corresponding fasteners 17 can then be loosened and the mounting plates 16 separated so that the center circuit breaker 12*b* can be removed through the window 43 defined by the faceplate 44. Accordingly, the center circuit breaker 12*b* can be replaced without dismantling either of the interlock slides 42*a*, 42*b*, thereby preserving the tamper-proof safety features of the invention previously described.

Figure 10:
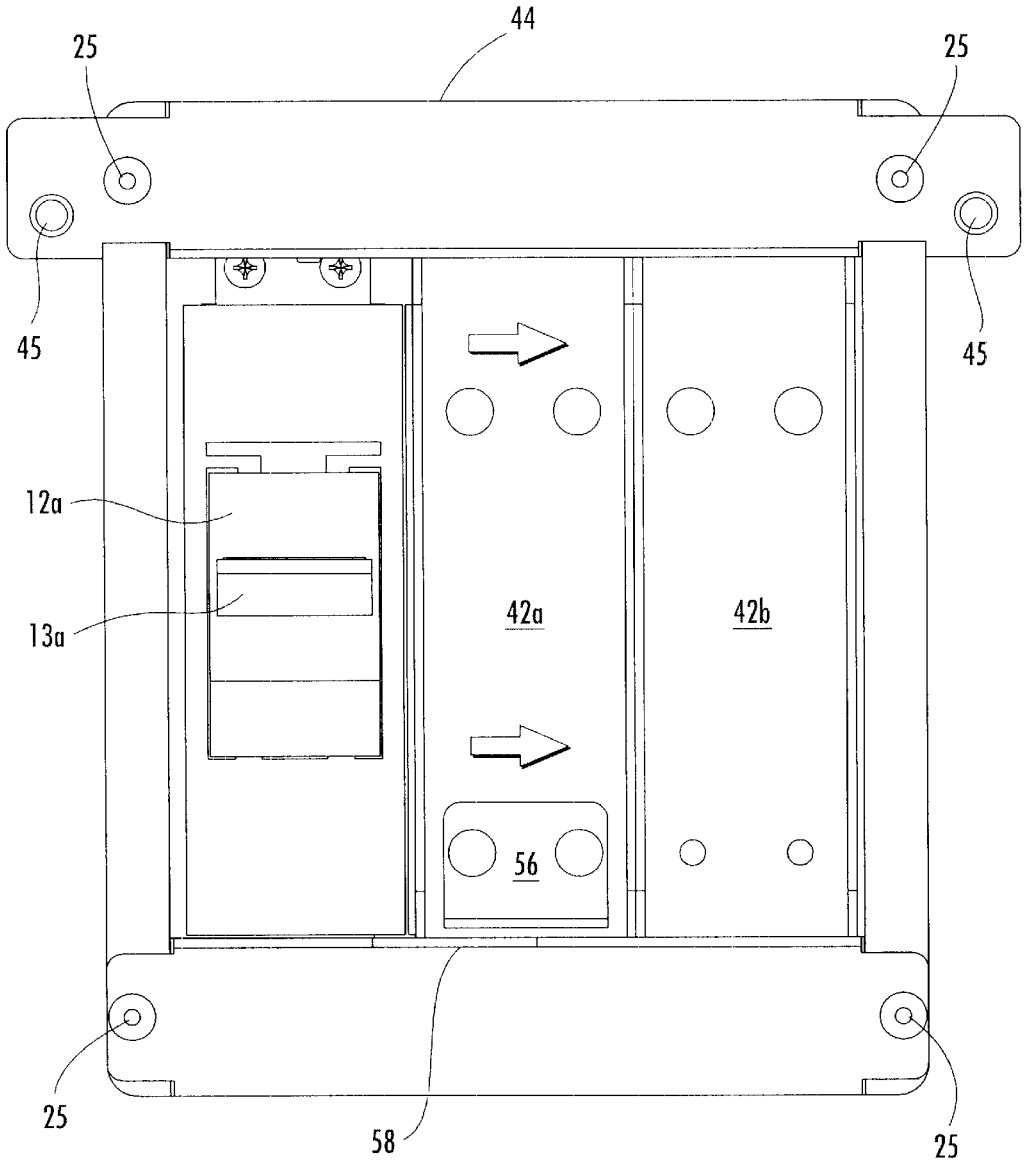
FIG. 10 is a front view of the circuit breaker mechanical interlock apparatus of FIG. 2 illustrating a third operational position of the interlock slides wherein the switch of the left-hand circuit breaker is accessible, but the switches of the remaining circuit breakers are not.

FIG. 10 illustrates a third operational position of the mechanical interlock apparatus 10 wherein the switch 13*a* of the left-hand circuit breaker 12*a* is accessible, but the switch 13*b* of the center circuit breaker 12*b* and the switch 13*c* of the right-hand circuit breaker 12*c* are not accessible. Accordingly, the switch 13*a* of the left-hand circuit breaker 12*a* can be moved between the OFF, NEUTRAL and ON positions as desired to de-energize, neutralize and/or energize the electrical system. The mechanical interlock apparatus 10 is positioned in the third operational position from the second operational position by first moving the switch 13*b* of the circuit breaker 12*b* from the ON position to the OFF position or to the NEUTRAL position. The left-hand slide 42*a* is then moved laterally between the inner flanges 26 and the outer flanges 28 to the right as indicated by the arrows thereon until the left-hand slide 42*a* overlies the switch 13*b* of the center circuit breaker 12*b*. As shown in FIG. 10, the switch 13*a* of the left-hand circuit breaker 12*a* is in the ON position and, as required, the switch 13*b* of the center circuit breaker 12*b* and the switch 13*c* of the right-hand circuit breaker 12*c* are in the NEUTRAL or OFF position. It should be noted that with the left-hand slide 42*a* positioned over the center circuit breaker 12*b* and the right-hand slide 42*b* positioned over the right-hand circuit breaker 12*c* as shown, the switch 13*a* of the left-hand circuit breaker 12*a* can be moved to the OFF position or to the NEUTRAL position. The corresponding fasteners 17 can then be loosened and the mounting plates 16 separated so that the left-hand circuit breaker 12*a* can be removed through the window 43 defined by the faceplate 44. Accordingly, the left-hand circuit breaker 12*a* can be replaced without dismantling either of the interlock slides 42*a*, 42*b*, thereby preserving the tamper-proof safety features of the invention previously described.

As is readily apparent, the interlock slides 42 can be positioned so that each of the switches 13 of the circuit breakers 12 is individually accessible, while the remaining switches 13 of the circuit breakers 12 are not accessible. The slides 42 can only be moved past the switches 13 of the circuit breakers 12 when the switches 13 are in the OFF position or in the NEUTRAL position. Accordingly, no more than one of the switches 13 of the circuit breakers 12 can be actuated at any given time to energize the electrical system electrically connected to the power sources. An important feature of the invention is that the number of interlock slides 42 movably mounted on the housing 20 is one fewer than the number of circuit breakers 12. Thus, the slides 42 can be moved laterally relative to the housing 20 to access any of the switches 13 of the circuit breakers 12 without the slides 42 extending beyond the periphery of the housing 20. As a result, the circuit breaker mechanical interlock apparatus 10 does not require additional space within the electrical enclosure 100 to operate. Accordingly, other electrical components can be located within the electrical enclosure 100 adjacent to the mechanical interlock apparatus 10 without interfering with the operation of the interlock slides 42, thereby increasing the density of electrical components that can be located within the electrical enclosure 100. In addition, the faceplate 44 prevents access to the slides 42 with the use of ordinary hand tools.

Many modifications and other embodiments of the invention will come to mind to one skilled in the art to which this invention pertains having the benefit of the teachings presented in the foregoing descriptions and the accompanying drawings. Accordingly, it is to be understood that the invention is not to be limited to the specific embodiments disclosed herein and that further modifications and other embodiments are intended to be included within the scope of the appended claims. Although specific terms are employed herein, they are used in a generic and descriptive sense only, and not for purposes of limitation.

That which is claimed is:

1. A circuit breaker mechanical interlock apparatus comprising a housing defining an outer perimeter and a circuit breaker receptacle;

a plurality of switch-type circuit breakers, each received within the circuit breaker receptacle and having a manually operable switch that is movable between at least two positions;

an interlock slide movably mounted on the housing between a first position wherein the interlock slide overlies a first one of the circuit breakers and thereby prevents movement of a first switch corresponding to the first circuit breaker and a second position wherein the interlock slide overlies a second one of the circuit breakers and thereby prevents movement of a second switch corresponding to the second circuit breaker; and a faceplate secured to the housing;

wherein the interlock slide is retained between the housing and the faceplate.

2. An apparatus according to claim 1 wherein the interlock slide is secured to the housing in a third position such that the interlock slide partially overlies the first circuit breaker and the second circuit breaker and thereby prevents movement of the first switch and the second switch.

3. An apparatus according to claim 1 wherein the second switch is accessible in the first position and the first switch is accessible in the second position.

4. An apparatus according to claim 3 wherein the second circuit breaker is removable from the receptacle defined by the housing in the first position and the first circuit breaker is removable from the receptacle defined by the housing in the second position.

5. An apparatus according to claim 1 wherein the interlock slide does not extend beyond the outer perimeter defined by the housing in the first position and the second position.

6. An apparatus according to claim 1 wherein the interlock slide comprises at least one shoulder bolt and at least a pair of cup washers that engage the shoulder bolt to retain the interlock slide between the housing and the faceplate.

7. An apparatus according to claim 6 wherein the housing comprises an inner flange and an outer flange that define a laterally extending slot therebetween and wherein the shoulder bolt is received within the slot so that the interlock slide is laterally movable relative to the housing.

8. An apparatus according to claim 1 wherein the interlock slide comprises a locking bar positioned adjacent the first switch in the first position and wherein the locking bar prevents lateral movement of the interlock slide from the first position to the second position when the second switch is in one of the at least two positions.

9. An apparatus according to claim 1 wherein the interlock slide comprises a locking bar positioned adjacent the second switch in the second position and wherein the locking bar prevents lateral movement of the interlock slide from the second position to the first position when the first switch is in one of the at least two positions.

10. A circuit breaker mechanical interlock apparatus comprising a housing having a back wall and a pair of side walls depending from the back wall, the back wall and the side walls defining a receptacle for receiving a plurality of switch-type circuit breakers, each of the switch-type circuit breakers having a manually operable switch that is movable between at least two positions;

an interlock slide mounted on the housing and movable between a first position wherein the interlock slide overlies a first circuit breaker of the switch-type circuit breakers and thereby prevents manual operation of a first switch corresponding to the first circuit breaker and a second position wherein the interlock slide overlies a second circuit breaker of the switch-type circuit breakers and thereby prevents manual operation of a second switch corresponding to the second circuit breaker; and a faceplate secured to the housing;

wherein the interlock slide is retained between the housing and the faceplate.

11. An apparatus according to claim 10 wherein the interlock slide is secured to the housing in a third position such that the interlock slide partially overlies the first circuit breaker and the second circuit breaker and thereby prevents movement of the first switch and the second switch.

12. An apparatus according to claim 10 wherein the second switch is accessible in the first position and the first switch is accessible in the second position.

13. An apparatus according to claim 12 wherein the second circuit breaker is removable from the receptacle defined by the housing in the first position and the first circuit breaker is removable from the receptacle defined by the housing in the second position.

14. An apparatus according to claim 10 wherein the interlock slide does not extend laterally beyond the side walls in the first position and the second position.

15. An apparatus according to claim 10 wherein the interlock slide comprises at least one shoulder bolt and at least a pair of cup washers that engage the shoulder bolt to retain the interlock slide between the housing and the faceplate.

16. An apparatus according to claim 15 wherein the housing comprises an inner flange and an outer flange that define a laterally extending slot therebetween and wherein the shoulder bolt is received within the slot so that the interlock slide is laterally movable relative to the housing.

17. An apparatus according to claim 10 wherein the interlock slide comprises a locking bar positioned adjacent the first switch in the first position and wherein the locking bar prevents lateral movement of the interlock slide from the first position to the second position when the second switch is in one of the at least two positions.

18. An apparatus according to claim 10 wherein the interlock slide comprises a locking bar positioned adjacent the second switch in the second position and wherein the locking bar prevents lateral movement of the interlock slide from the second position to the first position when the first switch is in one of the at least two positions.

19. An interlock slide for a circuit breaker mechanical interlock apparatus having a housing that defines a receptacle for receiving a plurality of manually operable switch-type circuit breakers, the interlock slide comprising a locking bar that overlies a first circuit breaker of the switch-type circuit breakers and thereby prevents manual operation of a first switch corresponding to the first circuit breaker when the interlock slide is in a first position;

means supporting the interlock slide on the housing such that the interlock slide is movable from the first position to a second position wherein the locking bar overlies a second circuit breaker of the switch-type circuit breakers that is parallel to and linearly adjacent to the first circuit breaker and thereby prevents manual operation of the second circuit breaker; and a faceplate secured to the housing;

wherein the interlock slide is retained between the housing and the faceplate.

20. An interlock slide according to claim 19 wherein the second circuit breaker is accessible and removable from the receptacle when the interlock slide is in the first position and the first circuit breaker is accessible and removable from the receptacle when the interlock slide is in the second position.

21. An interlock slide according to claim 19 wherein the interlock slide does not have an opening therethrough.

22. An interlock slide according to claim 19 further comprising at least one shoulder bolt and at least a pair of cup washers that engage the shoulder bolt to retain the interlock slide between the housing and the faceplate.

23. An interlock slide according to claim 22 wherein the housing comprises an inner flange and an outer flange that define a laterally extending slot therebetween and wherein the shoulder bolt is received within the slot so that the interlock slide is laterally movable relative to the housing.

24. A circuit breaker mechanical interlock apparatus for preventing more than one power source from energizing an electrical system at any given time, the apparatus comprising a housing defining a receptacle for receiving a plurality of switch-type circuit breakers, each of the circuit breakers having a manually operable switch that is movable between at least two positions for actuating one of a plurality of power sources electrically connected to a first circuit breaker of the switch-type circuit breakers and to the electrical system; and at least one interlock slide movably mounted on the housing adjacent the receptacle and opposite the switches of the circuit breakers, each interlock slide being movable relative to the circuit breakers to a first position wherein the interlock slide overlies the first circuit breaker and thereby prevents movement of a first switch corresponding to the first circuit breaker and to a second position wherein the interlock slide overlies a second circuit breaker of the switch-type circuit breakers and thereby prevents movement of a second switch corresponding to the second circuit breaker; and a faceplate secured to the housing;

wherein each interlock slide is retained between the housing and the faceplate.

25. An apparatus according to claim 24 wherein only one of the switch-type circuit breakers is accessible and removable from the receptacle in the first position and the second position.

26. An apparatus according to claim 24 wherein the housing defines an outer perimeter and wherein each interlock slide does not extend beyond the outer perimeter defined by the housing in the first position and the second position.

* * * * *